US011016419B2

(12) United States Patent
Sabo et al.

(10) Patent No.: US 11,016,419 B2
(45) Date of Patent: May 25, 2021

(54) PRINTING FLUID DEVELOPER ASSEMBLY

(71) Applicant: HP INDIGO B.V., Amstelveen (NL)

(72) Inventors: David Sabo, San Diego, CA (US); John W. Godden, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/487,749

(22) PCT Filed: Mar. 13, 2017

(86) PCT No.: PCT/US2017/022119

§ 371 (c)(1),
(2) Date: Aug. 21, 2019

(87) PCT Pub. No.: WO2018/169511

PCT Pub. Date: Sep. 20, 2018

(65) Prior Publication Data

US 2020/0241447 A1 Jul. 30, 2020

(51) Int. Cl.
*G03G 15/11* (2006.01)
*G03G 15/10* (2006.01)

(52) U.S. Cl.
CPC ..... *G03G 15/11* (2013.01); *G03G 15/101* (2013.01)

(58) Field of Classification Search
CPC ..... G03G 15/10; G03G 15/104
USPC ..... 399/237, 238, 239, 249
See application file for complete search history.

(56) References Cited

U.S. PATENT DOCUMENTS 4,060,321 A 11/1977 Butement
5,353,102 A 10/1994 Sato
7,395,005 B2 7/2008 Takada
7,668,488 B2 2/2010 Guzman
9,156,248 B1 10/2015 Thayer
2001/0026713 A1* 10/2001 Nishikawa ..... G03G 15/11 399/249
2006/0153597 A1* 7/2006 Guzman ..... G03G 15/104 399/237
2011/0249989 A1* 10/2011 Levintant ..... G03G 15/10 399/237
2013/0011162 A1* 1/2013 Nelson ..... G03G 15/104 399/239
2013/0223888 A1 8/2013 Tanner
2015/0055984 A1 2/2015 Lior
2015/0078785 A1* 3/2015 Tanner ..... G03G 15/10 399/238

(Continued)

OTHER PUBLICATIONS

Kawamoto, H., et al. "Doctor Process of Toner Layer in Non-Magnetic Single-Component Development System in Electrophotography." In NIP & Digital Fabrication Conference, vol. 2010. No. 1. pp. 213-215. (cont. below) Available at < http://www.ingentaconnect.com/content/ist/nipdf/2010/00002010/00000001/art00059 >.

*Primary Examiner* — Benjamin R Schmitt
(74) *Attorney, Agent, or Firm* — Fabian VanCott

(57) ABSTRACT

A binary printing fluid developer assembly may include a developer roller to receive a printing fluid and transfer a portion of the printing fluid to a photoconductive member; a number of electrodes to create an electrical potential bias between the number of electrodes and the developer roller; a cleaner roller to remove an amount of printing fluid from the developer roller; and a sponge roller to clean the cleaner roller wherein a gap is maintained between the sponge roller and the number of electrodes.

20 Claims, 6 Drawing Sheets

(56) References Cited

U.S. PATENT DOCUMENTS

2016/0085183 A1 3/2016 Lior

* cited by examiner

PRINTING FLUID DEVELOPER ASSEMBLY

BACKGROUND

Printing systems such as liquid electro photographic printers may include printing fluid developer assemblies to selectively form images on a photoconductive member. The binary printing fluid developer assemblies include a plurality of rollers arranged in contact with respect to each other.

BRIEF DESCRIPTION OF THE DRAWINGS

The accompanying drawings illustrate various examples of the principles described herein and are a part of the specification. The illustrated examples are given merely for illustration, and do not limit the scope of the claims.

Figure 1:
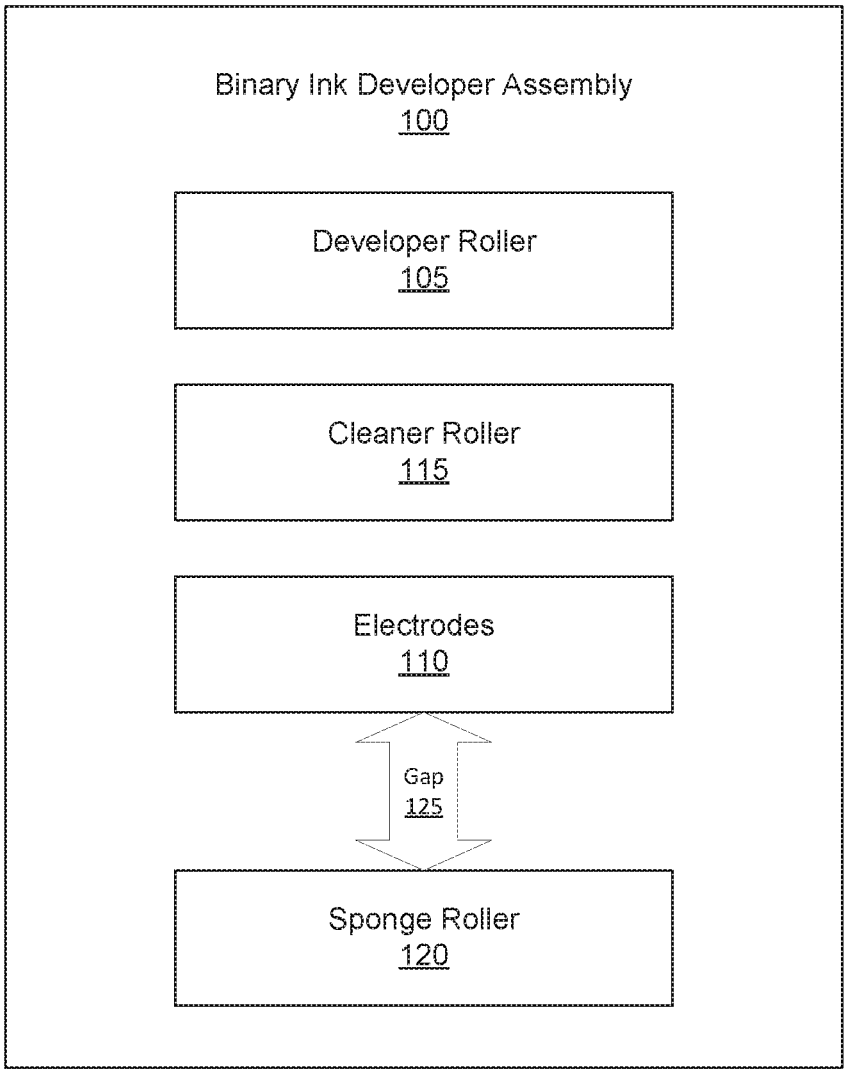
FIG. 1 is a block diagram of a binary printing fluid developer assembly according to one example of the principles described herein.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

As described above, printing systems and devices such as liquid electro photographic printing devices may include printing fluid developer assemblies to selectively form images on a photoconductive member. Each of the printing fluid developer assemblies may include any number of rollers in order to selectively place an amount of printing fluid onto a photoconductive member. The photoconductive member may then transfer that selectively applied printing fluid to a number of other rollers or to a sheet of media that is to receive that printing fluid.

In an example, each of the printing fluid developer assemblies may apply a distinct color of printing fluid such as liquid toner to the surface of the photoconductive member. In order to accomplish this, any number of printing fluid developer assemblies may be placed, circumferentially, around the cylindrical photoconductive member. This includes placing some of the printing fluid developer assemblies vertical while others horizontal or almost horizontal. Because each of the printing fluid developer assemblies include the liquid printing fluid described above, gravity may have a different effect on the flow of the printing fluid based on what orientation each printing fluid developer assembly has relative to the photoconductive member.

Additionally, the various rollers within each printing fluid developer assembly may lose some of its respective function based on the orientation of the printing fluid developer assembly relative to the photoconductive member. As an example, the various functions of a sponge roller within each printing fluid developer assembly may be effected based on the orientation of the printing fluid developer assembly. The functions of a sponge roller may include, among others, wiping a layer of printing fluid from a surface of a cleaner roller, remixing the printing fluid wiped from the surface of the cleaner roller with unused printing fluid, and using the properties of the sponge on the sponge roller to pump an amount of printing fluid from one portion of the printing fluid developer assembly to another portion. Because the gravity may be applied to the printing fluid differently based on the orientation of the printing fluid developer assembly, the functionality of the sponge roller may be reduced. This reduced functionality may result in errors in application of the printing fluid to the photoconductive member.

The functionality of the sponge roller may also cause other mechanical strains on the printing system implementing the printing fluid developer assemblies comprising the sponge rollers. In particular, in order to accomplish the functionalities of the sponge roller described above, the sponge roller is to rub up against a number of surfaces within the printing fluid developer assembly. Consequently, more torque may be used to drive the sponge roller in order to achieve the functional objectives of the sponge roller. This may increase the size of a motor used to drive the various rollers within the printing fluid developer assembly thereby increasing the size of the printing system. Additionally, because a relatively larger motor is used to help drive, among others, the sponge roller, the cost of the printing system implementing the printing fluid developer assemblies may also increase.

The present specification therefore describes a binary printing fluid developer assembly that may include a developer roller to receive a printing fluid and transfer a portion of the printing fluid to a photoconductive member; a number of electrodes to create an electrical potential bias between the number of electrodes and the developer roller; a cleaner roller to remove an amount of printing fluid from the developer roller; and a sponge roller to clean the cleaner roller wherein a gap is maintained between the sponge roller and the number of electrodes. The gap formed between the sponge roller and the number of electrodes allows the printing fluid to be transferred by the sponge roller from one location within the printing fluid developer assembly to another as well as reduce the friction between the sponge roller and the surfaces within the printing fluid developer assembly.

The present specification further describes a system for remixing excess printing fluid that may include a binary printing fluid developer assembly that includes a cleaner roller to clean a first amount of printing fluid from a surface of a developer roller, a sponge roller to remove the first amount of printing fluid from the cleaner roller and remix the first amount of printing fluid with a second amount of printing fluid; wherein the sponge roller has an interference with the cleaner roller of between 0 and 0.75 millimeters. In this example, the interference between the sponge roller and the cleaner roller may be reduced further preventing additional frictional forces to be applied to the surfaces within the printing fluid developer assembly by the sponge roller.

The present specification also describes a printing system that may include a number of printing fluid developers with each printing fluid developer including a developer roller; an electrode to create an electrical potential bias with the developer roller and transfer the printing fluid to the developer roller; a cleaner roller to clean an amount of printing fluid from the developer roller; and a sponge roller to remove and remix an amount of printing fluid from the cleaner roller wherein the sponge roller does not contact the electrode.

Examples described herein provide for a printing fluid developer assembly that may be oriented in any way relative to the photoconductive member while still providing accurate application of printing fluid onto the surface of at least the photoconductive member.

As used in the present specification and in the appended claims, the term "binary printing fluid developer" is meant to be understood as any device that applies an amount of printing fluid to a surface of a photoconductive member. The "printing fluid" in the "binary printing fluid developer" may be any type of printing fluid and is not necessarily limited in the present specification to any specific type of printing fluid.

Additionally, as used in the present specification and in the appended claims, the term "a number of" or similar language is meant to be understood broadly as any positive number comprising 1 to infinity; zero not being a number, but the absence of a number.

In the following description, for purposes of explanation, numerous specific details are set forth in order to provide a thorough understanding of the present systems and methods. It will be apparent, however, to one skilled in the art that the present apparatus, systems, and methods may be practiced without these specific details. Reference in the specification to "an example" or similar language means that a particular feature, structure, or characteristic described in connection with that example is included as described, but may or may not be included in other examples.

Turning now to the figures, FIG. 1 is a block diagram of a binary printing fluid developer assembly (100) according to one example of the principles described herein. The any number of binary printing fluid developers (100) may be implemented in a printing system as described herein and are used to apply a layer of printing fluid onto a surface of a photoconductive member.

The binary printing fluid developer (100) may include a developer roller (105), a cleaner roller (115), a number of electrodes (110), and a sponge roller (120). Although the present application describes the functionality of each of these rollers and the electrodes, the binary printing fluid developer (100) may comprise additional elements and rollers as well and the present specification contemplates the use of these additional elements and rollers. For ease of understanding, however, the present specification will describe the developer roller (105), a cleaner roller (115), a number of electrodes (110), and a sponge roller (120).

The binary printing fluid developer (100) includes any number of electrodes (110). In an example, the number of electrodes is two: a first electrode and a second electrode. The first and second electrodes may be held at respective predetermined voltages such as, for example, a negative electrical potential, to influence the printing fluid within the binary printing fluid developer (100) to move to a developer roller (105). The negative potential can be, for example, −1500 volts, but could be some other potential. During operation, the fluidic printing fluid is made to migrate from the first and second electrodes to the developer roller (105) and selectively coat the developer roller. The developer roller (105) is held at a respective predetermined electrical potential. The electrical potential of the developer roller (105) may be less negative than any one of the number of electrodes (110). Example implementations can be realized in which the developer roller (105) is held at, for example, −450 volts, but could be some other suitable voltage.

During operation of the binary printing fluid developer (100), the developer roller (105) may have some printing fluid removed from the surface of thereof in order to selectively apply a new layer of printing fluid thereon. The cleaner roller (115) accomplishes this by also being held at a predetermined electrical potential. Printing fluid that is not transferred from the developer roller (105) to, for example, a photoconductive member such as a photo imaging plate (PIP), is referred to as unused printing fluid. The cleaner roller (115) may be rotating in an opposite direction (clockwise or counterclockwise) relative to the developer roller (105) in order to clean the developer roller (105) of any unused printing fluid.

To accomplish this, the cleaner roller (115) may be held at a predetermined potential that, in an example, is relatively less negative than that of the developer roller (105). For example, the cleaner roller's (115) predetermined potential can be −250 volts, but can be some other suitable voltage as well to achieve the functions described herein. In this way, the cleaner roller (115) cleans the unused printing fluid from the developer roller (105). In some examples, the electrical potential of the cleaner roller (115) may change over time in order to compensate for the age of the binary printing fluid developer (100), the relative resistivity of the other elements within the binary printing fluid developer (100), or some other parameters.

The sponge roller (120) may, in turn, help to remove an amount of printing fluid from the surface of the cleaner roller (115). The sponge roller (120) may rotate in the same direction (counterclockwise) as the cleaner roller (115). The sponge roller (120) comprises a sponge layer wrapped around a metal core with the sponge layer bearing a number of open cells or pores. The metal core layer may be, in an example, 10 millimeters in diameter. In some examples, the sponge layer of the sponge roller (120) may include an open-cell material such as, for example, polyurethane foam. The sponge layer of the sponge roller (120) is resiliently compressible and, in some examples is compressed by the cleaner roller (115) as well as other elements within the binary printing fluid developer (100), taken jointly and severally in any and all permutations.

The sponge roller (120) may, in an example, also cooperate with a doctor blade to recover an amount of unused printing fluid from the surface of the cleaner roller (115). That is, any unused printing fluid remaining on the cleaner roller (115) that is not removed by the sponge roller (120) is scraped from the cleaner roller (115) onto the sponge roller (120) by the doctor blade. The binary printing fluid developer (100) may further include a wiper wall to squeeze the sponge roller (120) in order to squeeze an amount of mixed printing fluid from the sponge roller (120) and cause the sponge roller (120) to absorb the unused printing fluid from the cleaner roller (115) and mix it with existing printing fluid in the binary printing fluid developer (100).

In the examples provided herein, a physical gap (125) between the sponge roller (120) and the number of electrodes (110) is maintained. Rather than providing a bump or protrusion on at least one of the number of electrodes (110) to interface with the sponge roller (120), the number of electrodes (110) to not make contact with the sponge roller (120). The bump or protrusion of the number of electrodes (110) was previously used to mix an amount of printing fluid removed from the cleaner roller (115) with printing fluid present at or around the developer roller (105), cleaner roller (115), and/or sponge roller (120). The mixing process previously engaged in by the sponge roller (120)/electrode (110) interface may be limited to some degree in the present description. By not providing the bump or protrusion on the number of electrodes (110) to interface with the sponge roller (120), the torque used to turn the sponge roller (120) may be relatively less than otherwise. Still further, as will be described herein, the elimination of this bump or protrusion from the number of electrodes (110) may prevent air bubbles from accumulating near the developer roller (105) and preventing the printing fluid from contacting the developer roller (105).

In an example, instead of, or in addition to, removing the bump or protrusion from the number of electrodes (110), the diameter of the sponge roller (120) may be reduced. In this example, the gap (125) may be maintained between the number of electrodes (110) and the sponge roller (120) and the interference between the sponge roller (120) and the cleaner roller (115) may also be reduced. In an example, the cleaner roller (115) and the sponge roller (120) causes the sponge roller (120) to compress a distance between 0 to 0.75 mm when engaging with the cleaner roller (115). In an example, the cleaner roller (115) and the sponge roller (120) causes the sponge roller (120) to compress a distance of 0.375 millimeters.

The reduction of the diameter of the sponge roller (120) may reduce the ability of the sponge roller (120) to clean the cleaner roller (115) but in exchange reduces the amount of torque used to turn the sponge roller (120). In an example, the diameter of the sponge roller (120) may be between 19 and 17 millimeters. In an example, the diameter of the sponge roller (120) is 18.5 millimeters.

Forming a gap (125) between the number of electrodes (110) and the sponge roller (120) also allows for the binary printing fluid developer (100) to be rotated during operation without having the additional side effect of used or unused printing fluid or air bubbles accumulating near or around the developer roller (105). As briefly mentioned above, the presence of air bubbles at or near the developer roller (105) may prevent the application of the printing fluid onto the developer roller (105) causing a poor image to be formed on a sheet of media downstream of the developer roller (105). Additionally, an unused amount of printing fluid removed from the cleaner roller (115) should be remixed with an amount of printing fluid not applied to the developer roller (105) in order to maintain a relatively more homogenous mixture of the printing fluid. In this example, as the binary printing fluid developer (100) is rotated relatively more horizontally, gravity may prevent the sponge roller (120) from mixing the two types of printing fluid sufficiently because the bump or protrusions formed on the number of electrodes (110) act as a dam rather than a mixing location. With the gap (125) present between the sponge roller (120) and number of electrodes (110), the sponge roller (120) may carry any used, unused, or other type of printing fluid away from the developer roller (105) to be mixed at a different location in the binary printing fluid developer (100) away from the developer roller (105). This also prevents air bubbles from forming behind the moving printing fluid.

Figure 2:
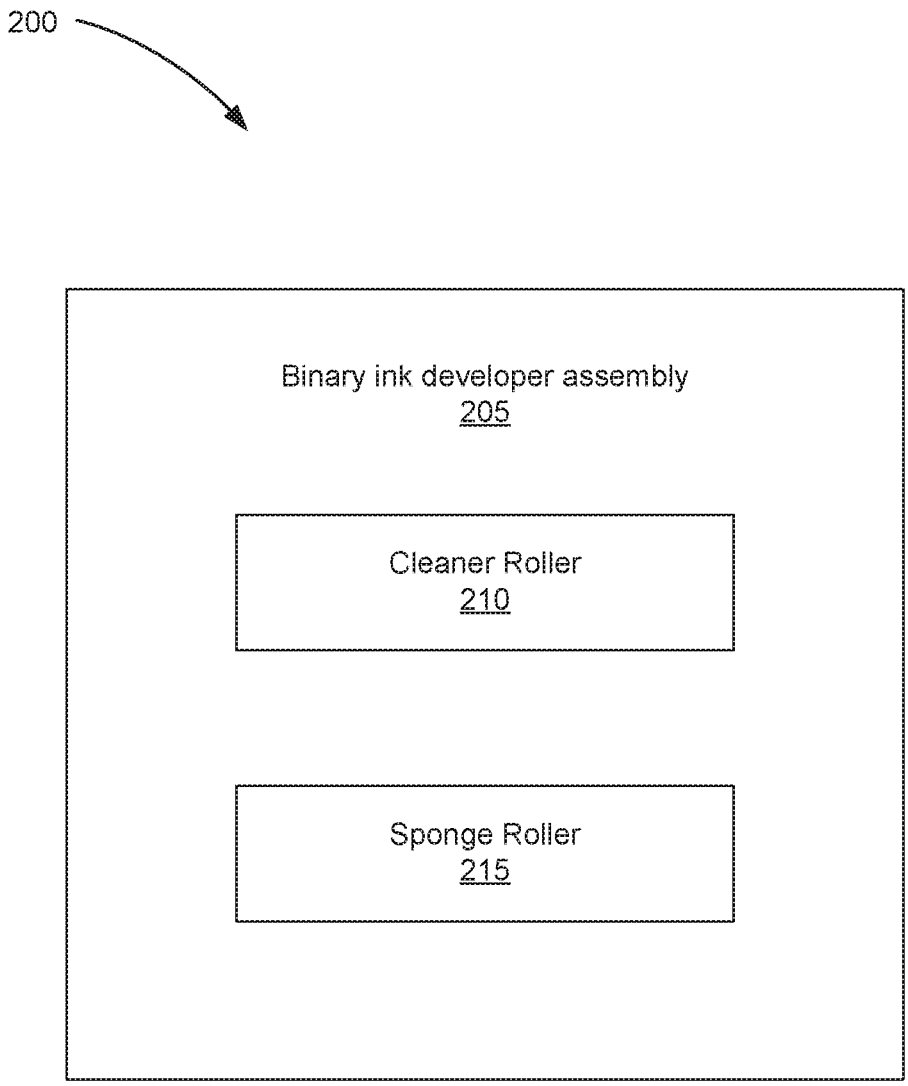
FIG. 2 is a block diagram of a system for remixing excess printing fluid according to an example of the principles described herein.

FIG. 2 is a block diagram of a system (200) for remixing excess printing fluid according to an example of the principles described herein. As used in the present specification and in the appended claims, the term "excess printing fluid" is meant to be understood as printing fluid within the binary printing fluid developer (FIG. 1, 100) that is either initially not applied to the surface of the developer roller (105) or is removed from the surface of the cleaner roller (205) by the sponge roller (210) or doctor blade as described herein. During operation of the binary printing fluid developer assembly (200), levels of a liquid within the printing fluid may be at various ranges for a number of portions of the printing fluid. In order to maintain a relatively high homogeneity of the printing fluid, the excess printing fluids may be remixed. In an example, the remixing may be accomplished, at least partially, by the sponge roller (120) as described herein.

The system (200) may include a binary printing fluid developer assembly (205) similar to that described above in connection with FIG. 1. The binary printing fluid developer assembly (205) may include a cleaner roller (210) and a sponge roller (215). The cleaner roller (210) and sponge roller (215) of FIG. 2 may have similar characteristics and functions as described above in connection with the cleaner roller (FIG. 1, 115) and sponge roller (FIG. 1, 120) of FIG. 1. In the example of FIG. 2, however, the sponge roller (215) has an interference with the cleaner roller (210) of between 0 and 0.75 millimeters. This results in the sponge roller being deformed against the metallic surface of the cleaner roller (210) such that a maximum diameter of the sponge roller (215) is deformed by between 0 and 0.75 millimeters. In an example, the deformation of the sponge roller (215) is 0.375 millimeters.

In these examples, the sponge roller (215) may function relatively less as a device to dean off the cleaner roller (210) in comparison to a sponge roller (215) that had, for example, a diameter of 20.75 millimeters. However, the reduced friction of the sponge roller (215) against, at least, the cleaner roller (210) reduces the torque used to turn the sponge roller (215).

Figure 3:
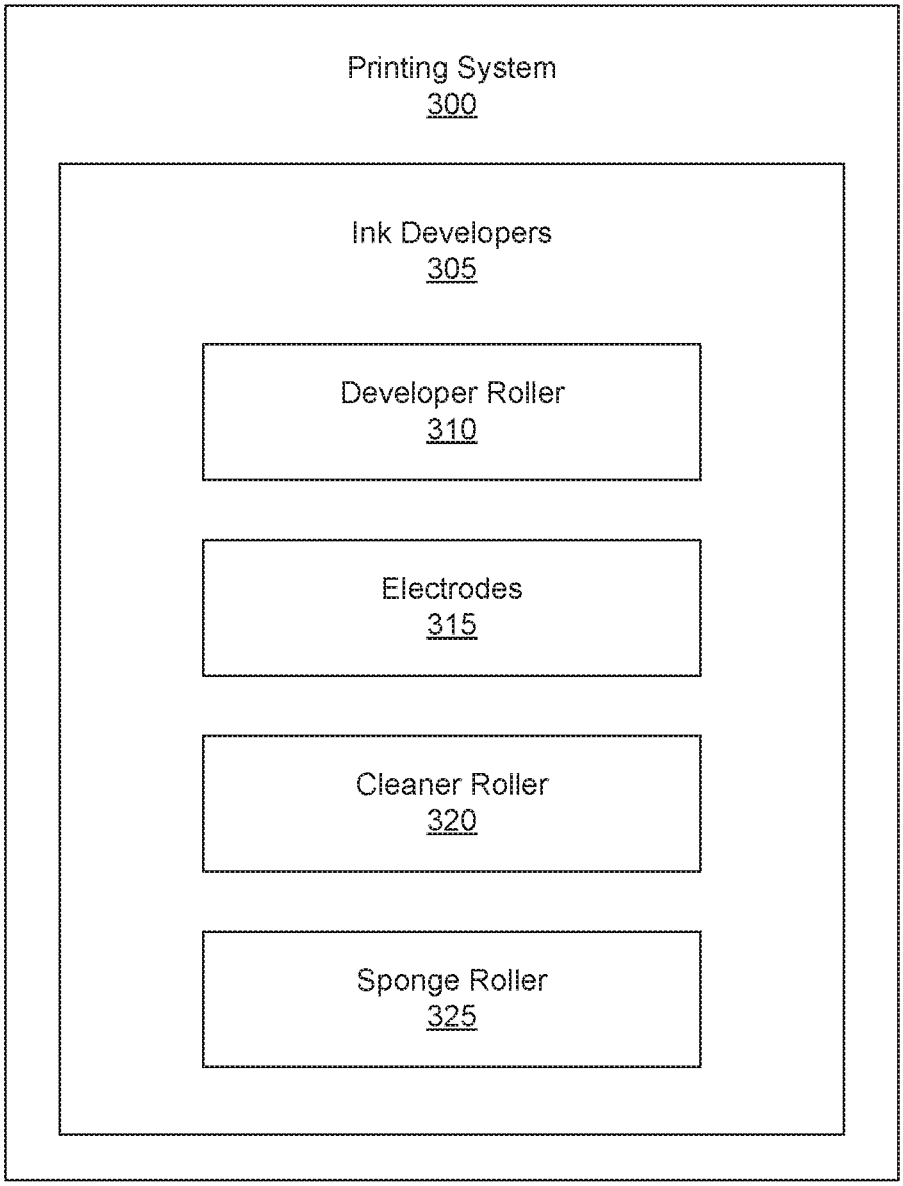
FIG. 3 is a block diagram of a printing system according to an example of the principles described herein.

FIG. 3 is a block diagram of a printing system (300) according to an example of the principles described herein. The printing system (300) may include a number of printing fluid developers (305) with each printing fluid developer (305) including a developer roller (310), a number of electrodes (315), a cleaner roller (320), and a sponge roller (325). The developer roller (310), electrodes (315), cleaner roller (320), and sponge roller (325) may be similar in form and function to the developer roller, electrodes, cleaner rollers, and sponge rollers as described in connection with FIGS. 1 and 2. In this example, the sponge roller (325) does not contact the electrodes (315). As described herein, preventing the sponge roller (325) from contacting the electrodes (315) provides for relatively less torque used to turn the sponge roller (325). Additionally, as described herein, any excess printing fluid at or near the developer roller (310) may be passed away from the developer roller (310) thereby allowing the excess printing fluid to mix and create a relatively more homogeneous printing fluid to be used to selectively coat the developer roller (310). Still further, in the instances wherein the printing fluid developers (305) are placed horizontally against, for example, a photoconductive member, the printing fluid and any air bubbles accumulated at or near the developer roller (310) may be directed away from the developer roller (310) by the turning of the sponge roller (325) and will not be trapped at an interface where the electrodes (315) contact the sponge roller (325).

Figure 4A:
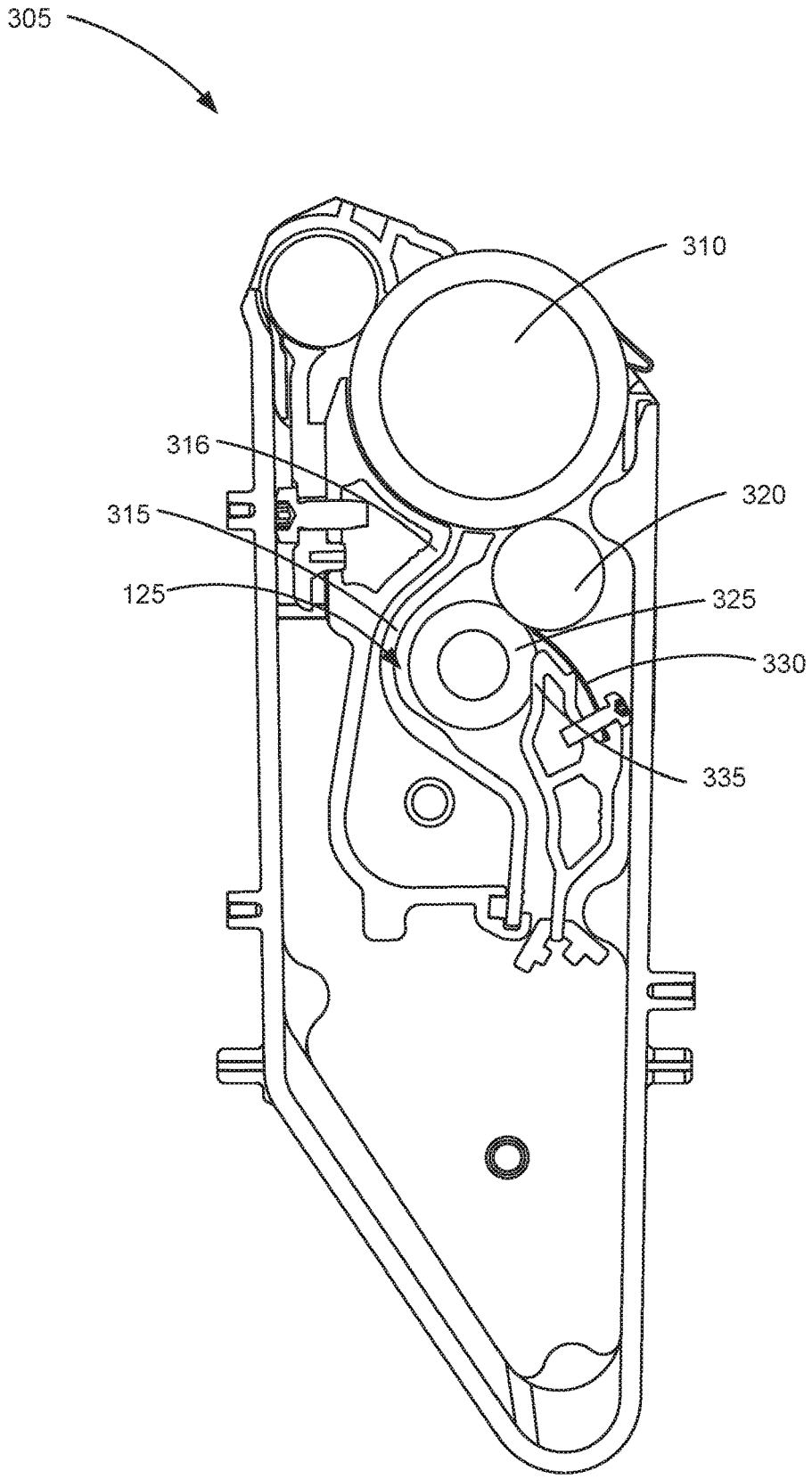
FIGS. 4A and 4B are cutaway side views of the printing fluid developer of FIG. 3 according to an example of the principles described herein.
Figure 4B:
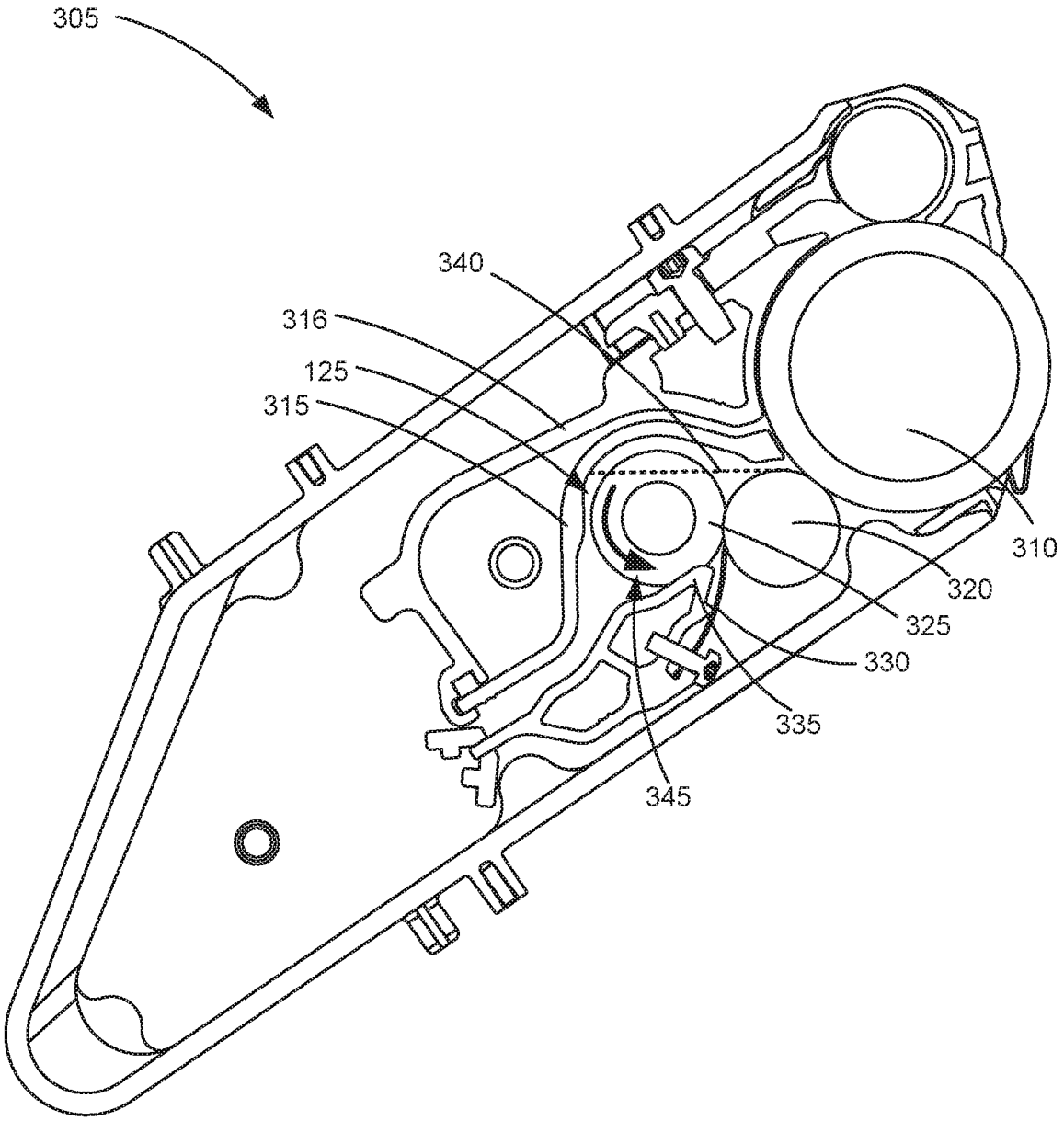

FIGS. 4A and 4B are cutaway side views of the printing fluid developer (305) of FIG. 3 according to an example of the principles described herein. As described above, during operation of the printing fluid developer (305), an amount of printing fluid may be attracted to the developer roller (310) via the electrical potentials of the first and second electrodes (315, 316) and developer roller (310). As the printing fluid is electrically coupled to the developer roller (310), the developer roller (310) may transfer some of the printing fluid to a photoconductive element such as a photo imaging plate (PIP). However, because a portion of the printing fluid is applied to the PIP, some remains on the developer roller (310) and the cleaner roller (320) is in place to remove the left-over portion of the printing fluid. In so doing, the printing fluid on the cleaner roller (320) may be removed through the use of the sponge roller (325) and doctor blade (330). In this example, however, the sponge roller (325) may not come in contact with the first electrode (315) via a bump or protrusion formed in the first electrode (315). Instead, a gap (125) is formed and maintained between the sponge roller (325) and the first electrode (315). Again, this results in relatively less torque used to drive the sponge roller (325) via, for example, a motor.

Even further, the diameter of the sponge roller (325) may be reduced in order to not come in contact with the first electrode (315) as well as to also be less deformed through interaction with other parts within the printing fluid developer (305) such as the cleaner roller (320) and a wiper wall (335). As described above, the wiper wall (335) may squeeze an amount of printing fluid absorbed by the porous layer of the sponge roller (325) allowing gravity to take the absorbed printing fluid away from the developer roller (310). The diameter of the sponge roller (325) may be reduced to 18.5 millimeters resulting in a 0.375-millimeter interference of the sponge roller (325) with the cleaner roller (320).

FIG. 4B shows the printing fluid developer (305) in a less than vertical position as described above. This orientation of the printing fluid developer (305) places the sponge roller (325) out from under the developer roller (310), but in some instances a portion of the sponge roller (325) may be under the developer roller (310). A line (340) has been drawn showing where printing fluid and air bubbles may form between the sponge roller (325) and first electrode (315) if a bump or protrusion was formed between the sponge roller (325) and first electrode (315). In this case, because no such bump or protrusion has been formed and because the sponge roller (325) is not in contact with the first electrode (315), a gap (125) is formed and maintained. As the printing fluid developer (305) is oriented in this position, the sponge roller (325) causes any printing fluid to be pulled in the direction of the turn of the sponge roller (325) indicated by the arrow (345).

Figure 5:
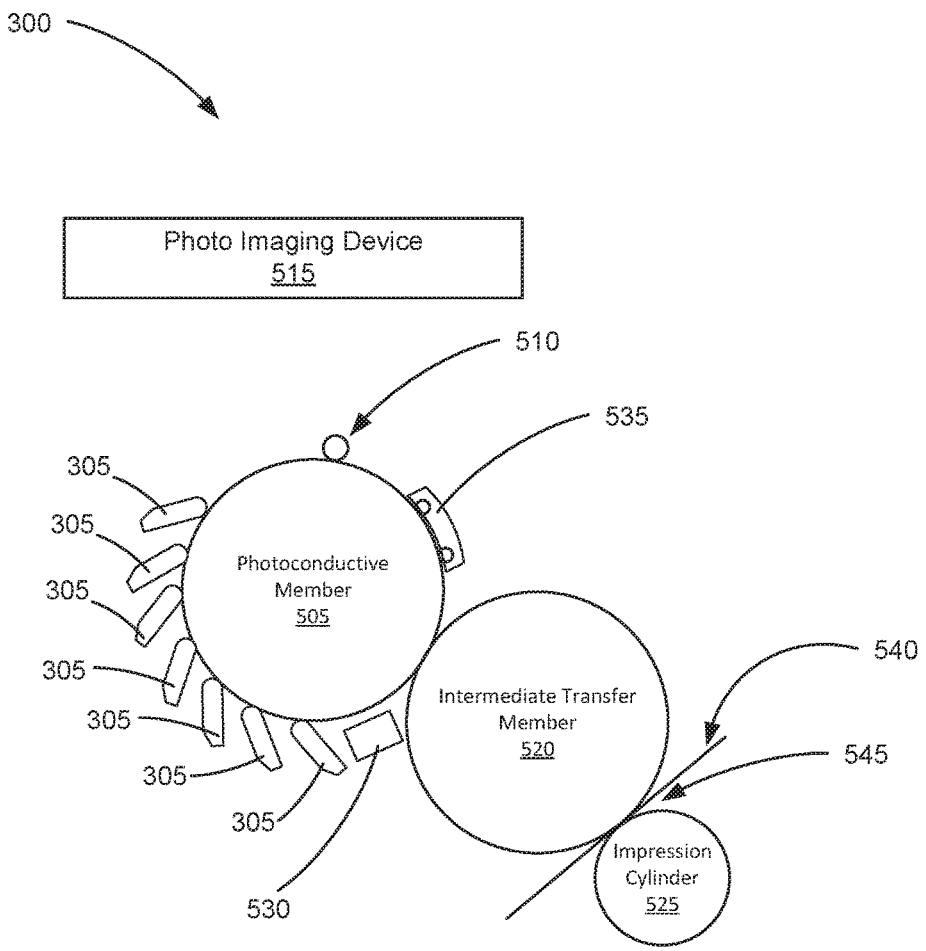
FIG. 5 is a diagram of a printing system implementing a plurality of printing fluid developers (305) of FIGS. 4A and 4B according to an example of the principles described herein.

FIG. 5 is a diagram of a printing system (300) implementing a plurality of printing fluid developers (305) of FIGS. 4A and 4B according to an example of the principles described herein. FIG. 5 shows specifically the layout of a number of printing fluid developers (305) oriented around a photoconductive member (505) such as a PIP. As described above, each of the printing fluid developers (305) may be oriented differently around to the photoconductive member (505) such that the orientation of each of the printing fluid developers (305) may vary from vertical to horizontal. Again, due to gravity, this effects the flow of the printing fluid in each of the printing fluid developers (305).

Along with the other elements described in connection with the printing fluid developers (305), the system (300) may further include the photoconductive member (505), a charging device (510), a photo imaging device (515), an intermediate transfer member (ITM) (520), an impression cylinder (525), a discharging device (530), and a cleaning station (535). The printing fluid developers (305) are disposed adjacent to the photoconductive member (505) and may correspond to various colors such as cyan, magenta, yellow, black, and the like. The charging device (510) applies a uniform electrostatic charge to a photoconductive surface such as the outer surface of the photoconductive member (505). A photo imaging device (515) such as a laser exposes selected areas on the photoconductive member (505) to light in a pattern of the desired printed image to dissipate the charge on the selected areas of photoconductive member (505) exposed to the light.

For example, the discharged areas on photoconductive member (505) form an electrostatic image which corresponds to the image to be printed. A thin layer of printing fluid is applied to the patterned photoconductive member (505) using the various printing fluid developers (305) to form the latent image thereon. The printing fluid adheres to the discharged areas of photoconductive member (505) in a uniform layer of printing fluid on the photoconductive member (505) and develops the latent electrostatic image into a toner image, the toner image is transferred from the photoconductive member (505) to the ITM (520). Subsequently, the toner image is transferred from the ITM (520) to the print medium (540) as the print medium (540) passes through an impression nip (545) formed between the ITM (520) and the impression cylinder (525). The discharging device (530) removes residual charge from the photoconductive member (505). The cleaning station (535) removes toner residue in preparation of developing the new image or applying the next toner color plane.

The specification and figures describes a printing fluid developer assembly that includes a gap created between a sponge roller and an electrode. The gap allows printing fluid and air bubbles to pass between the sponge roller and electrode. The printing fluid developer further provides for a relatively smaller diameter sponge roller that interacts less with the elements within the printing fluid developer assembly reducing the torque used to turn the sponge roller. By preventing air bubbles from forming near the developer roller, the gap prevents the formation of voids on a printed media due to printing fluid not gaining access to the surface of the developer roller. Additionally, a torque used for active pumping of printing fluid downwards and friction against cleaner roller is significantly reduced which prevents motor drive failures due to high torque and improves reliability of drive train components associated with the printing fluid developer assembly.

The preceding description has been presented to illustrate and describe examples of the principles described. This description is not intended to be exhaustive or to limit these principles to any precise form disclosed. Many modifications and variations are possible in light of the above teaching.

What is claimed is:

1. A binary printing fluid developer assembly, comprising:

a developer roller to receive a printing fluid and transfer a portion of the printing fluid to a photoconductive member;

a number of electrodes to create an electrical potential bias between the number of electrodes and the developer roller;

a cleaner roller to remove an amount of printing fluid from the developer roller; and a sponge roller to clean the cleaner roller, wherein a first electrode is curved to match a circumference of the sponge roller;

wherein:

on a first side of the sponge roller, a curved gap is maintained between the sponge roller and the first electrode; and on a second and opposite side of the sponge roller, the sponge roller contacts a wiper wall.

2. The binary printing fluid developer assembly of claim 1, wherein the sponge roller is compressed a distance between 0 to 0.75 millimeters by the cleaner roller.

3. The binary printing fluid developer assembly of claim 1, wherein the sponge roller has a diameter of between 19 and 17 millimeters.

4. The binary printing fluid developer assembly of claim 1, wherein the number of electrodes comprises multiple electrodes alongside the first side of the sponge roller.

5. The binary printing fluid developer assembly of claim 1, wherein the wiper wall comprises a squeezing bump downstream of an interface between the cleaner roller and sponge roller to squeeze out an amount of printing fluid from a surface of the sponge roller before the surface of the sponge roller interfaces with the cleaner roller.

6. The binary printing fluid developer assembly of claim 5, wherein the squeezing of the sponge roller by the squeezing bump of the wiper wall causes a pumping effect to pump printing fluid into and out of the sponge roller.

7. The binary printing fluid developer assembly of claim 1, wherein the number of electrodes have a negative electrical potential to draw the printing fluid towards the developer roller.

8. The binary printing fluid developer assembly of claim 7, wherein the developer roller has a negative electrical potential that is less negative than the negative electrical potential of the number of electrodes.

9. The binary printing fluid developer assembly of claim 8, wherein the cleaner roller has a negative electrical potential that is less negative than the negative electrical potential of the developer roller.

10. The binary printing fluid developer assembly of claim 9, wherein the negative electrical potential of the cleaner roller changes over time.

11. The binary printing fluid developer assembly of claim 1, wherein:

the cleaner roller is to rotate in an opposite direction relative to the developer roller; and the sponge roller is to rotate in a same direction relative to the cleaner roller.

12. A system for remixing excess printing fluid, comprising:

a binary printing fluid developer assembly, comprising:

a number of electrodes to create an electrical potential bias between the number of electrodes and a developer roller;

a cleaner roller to clean a first amount of printing fluid from a surface of the developer roller;

a sponge roller to remove the first amount of printing fluid from the cleaner roller and remix the first amount of printing fluid with a second amount of printing fluid;

wherein:

a first electrode is curved to match a circumference of the sponge roller;

the sponge roller has an interference with the cleaner roller of between 0 and 0.75 millimeters;

on a first side of the sponge roller, a curved gap is maintained between the sponge roller and the first electrode; and on a second and opposite side of the sponge roller, the sponge roller contacts a wiper wall.

13. The system of claim 12 wherein:

the binary printing fluid developer assembly further comprises at least one electrode passing immediately alongside the sponge roller; and the gap is to allow an amount of mixed first and second amount of printing fluid to be passed away from the developer roller.

14. The system of claim 13 wherein the at least one electrode comprises a protuberance on a side of the at least one electrode where the sponge roller is placed and wherein the gap is maintained between the protuberance and the sponge roller.

15. The system of claim 12, wherein the binary printing fluid developer assembly further comprises a doctor blade to remove the first amount of printing fluid from off of a surface of the cleaner roller.

16. The system of claim 12, wherein a vertical plane through an axis of the developer roller does not intersect the sponge roller.

17. A printing system, comprising:

a number of printing fluid developers, each printing fluid developer comprising:

a developer roller;

an electrode to create an electrical potential bias with the developer roller and transfer the printing fluid to the developer roller;

a cleaner roller to clean an amount of printing fluid from the developer roller; and a sponge roller to remove an amount of printing fluid from the cleaner roller, wherein a first electrode is curved to match a circumference of the sponge roller;

wherein:

on a first side of the sponge roller, a curved gap is maintained between the sponge roller and the first electrode; and on a second and opposite side of the sponge roller, the sponge roller contacts a wiper wall.

18. The printing system of claim 17 wherein an interface of the sponge roller to the cleaner roller has an overlap of between 0 and 0.75 millimeters.

19. The printing system of claim 17, wherein each of the developer rollers of the printing fluid developers interface, circumferentially, around a photoconductive roller with each of the developer rollers providing a different type of printing fluid to the developer roller.

20. The printing system of claim 17, wherein the sponge roller has a diameter of between 19 and 17 millimeters.

* * * * *